US007491439B2

(12) United States Patent
Price

(10) Patent No.: US 7,491,439 B2
(45) Date of Patent: Feb. 17, 2009

(54) SHELF LINER WITH NATURAL FIBERS

(75) Inventor: Shelley W. Price, Vermilion, OH (US)

(73) Assignee: Henkel Corporation, Rocky Hill, CT (US)

( * ) Notice: Subject to any disclaimer, the term of this patent is extended or adjusted under 35 U.S.C. 154(b) by 357 days.

(21) Appl. No.: 10/950,830

(22) Filed: Sep. 27, 2004

(65) Prior Publication Data

US 2006/0068192 A1 Mar. 30, 2006

(51) Int. Cl.
*B32B 3/26* (2006.01)
*B32B 5/28* (2006.01)

(52) U.S. Cl. ..... 428/316.6; 428/131; 428/195.1; 442/43; 427/256; 427/288; 427/430.1; 427/439

(58) Field of Classification Search ..... 442/43; 428/316.6, 131, 195.1; 427/256, 288, 430.1, 427/439

See application file for complete search history.

(56) References Cited

U.S. PATENT DOCUMENTS 2,649,391 A 8/1953 Alderfer
3,264,167 A 8/1966 Sands
3,607,599 A * 9/1971 McPherson ..... 428/105
3,778,337 A 12/1973 Mand et al.
3,928,627 A 12/1975 Mand et al.
4,055,694 A 10/1977 Hadgraft et al.
4,145,467 A 3/1979 Malik
4,245,689 A 1/1981 Grard et al.
4,291,082 A * 9/1981 Stall ..... 428/138
4,722,954 A 2/1988 Hallworth
4,752,510 A 6/1988 Hallworth
4,858,339 A * 8/1989 Hayafuchi et al. ..... 36/45
5,707,903 A 1/1998 Schottenfeld
5,854,144 A 12/1998 Hawley
5,863,845 A 1/1999 Owen
5,874,371 A 2/1999 Owen
5,906,878 A * 5/1999 Horning et al. ..... 428/131
6,130,174 A 10/2000 Hawley et al.
6,558,786 B1 * 5/2003 Jupina ..... 428/316.6
6,599,600 B1 7/2003 Wyman
6,673,179 B1 * 1/2004 Mangum et al. ..... 156/79
2002/0197922 A1 12/2002 Sobonya et al.
2003/0121202 A1 * 7/2003 Hinsperger ..... 47/9
2003/0206775 A1 11/2003 Markusch et al.
2004/0117903 A1 * 6/2004 Hinsperger
2005/0069231 A1 * 3/2005 Mohamed ..... 383/125

OTHER PUBLICATIONS www.americannonslipcom, Capitol USA, Copyright 2002.

* cited by examiner

*Primary Examiner*—Hai Vo
(74) *Attorney, Agent, or Firm*—Fay Sharpe LLP

(57) ABSTRACT

A shelf liner (10) with a natural appearance includes a skid-resistant first major surface and a decorative second major surface. The shelf liner includes a scrim (12) and a foamed resin (14), which is in contact with the scrim. The resin leaves at least a portion of the scrim exposed on the second major surface.

15 Claims, 1 Drawing Sheet

SHELF LINER WITH NATURAL FIBERS

BACKGROUND

1. Field of the Invention

The present exemplary embodiment relates to a sheet material useful as a drawer liner for drawers, shelves, or other decorative surfaces.

2. Background of the Invention

Drawer liners and shelf liners have been formed as sheet materials from scrim covered in a foamed plastic. The scrim is generally porous and has openings, which pass from one surface to the other. The foamed plastic tends to reduce the size of the openings, while completely covering the fibers of the scrim. To provide a smooth sheet material, a smooth film of a non-foamed plastic is often laminated over one surface of the coated scrim. The foam plastic coated scrim acts as a non-slip base for the shelf liner or drawer liner. Composite sheet materials of this type are disclosed, for example, in U.S. Pat. Nos. 5,707,903; 5,854,144; 5,863,845; 5,874,371; and 6,130,174.

US Application No. 2002/0197922 discloses a sheet product which comprises a scrim embedded in a continuous layer of a foamed resin. The sheet material is useful as a drawer liner or a shelf liner and is fabricated without need for lamination of separate layers to a scrim material.

Foams used to form liners are typically formed from poly (vinyl chloride)(PVC). Over time, plasticizers used in forming the PVC foam can migrate out of the liner and mar wood or lacquered surfaces.

BRIEF DESCRIPTION

In accordance with one aspect of the present exemplary embodiment, a shelf liner is provided. The shelf liner defines a skid-resistant first major surface and a decorative second major surface. The sheet material includes a scrim. A foamed resin is in contact with the scrim. The resin is discontinuous on the scrim, such that it leaves at least a portion of the scrim visible on the second major surface.

In accordance with another aspect of the present exemplary embodiment, a composite sheet material is provided. The sheet material defines a first exposed major surface, which is non-adhesive and skid-resistant, and a second exposed major surface. The sheet material includes a scrim formed of natural fibers and a foamed latex resin thereon which defines a portion of the first and second major surfaces. The foamed latex resin is thicker, on average, on the second major surface than on the first major surface.

In accordance with another aspect of the present exemplary embodiment, a method for forming a sheet material is provided. The method includes impregnating a scrim formed of natural fibers with a latex composition and scraping a portion of the latex composition away from a first major surface of the scrim, such that the natural fibers are more visible on the first major surface than on a second major surface.

In accordance with another aspect of the present exemplary embodiment, a composite sheet material is provided. The sheet material has first and second major surfaces and consists essentially of a scrim formed of natural fibers and a foamed latex resin thereon. The foamed latex resin provides discontinuous coverage of the scrim on the second major surface to provide a decorative surface.

An advantage of at least one embodiment is that a liner with a decorative surface and a non-skid surface is formed without the need for lamination of separate layers.

Another advantage of at least one embodiment is that a decorative liner is formed without adhesive which does not include plasticizers which tend to mar wood and lacquer.

Still further advantages will become apparent to those of ordinary skill in the art upon reading and understanding the following detailed description of the preferred embodiments.

DETAILED DESCRIPTION

Figure 1:
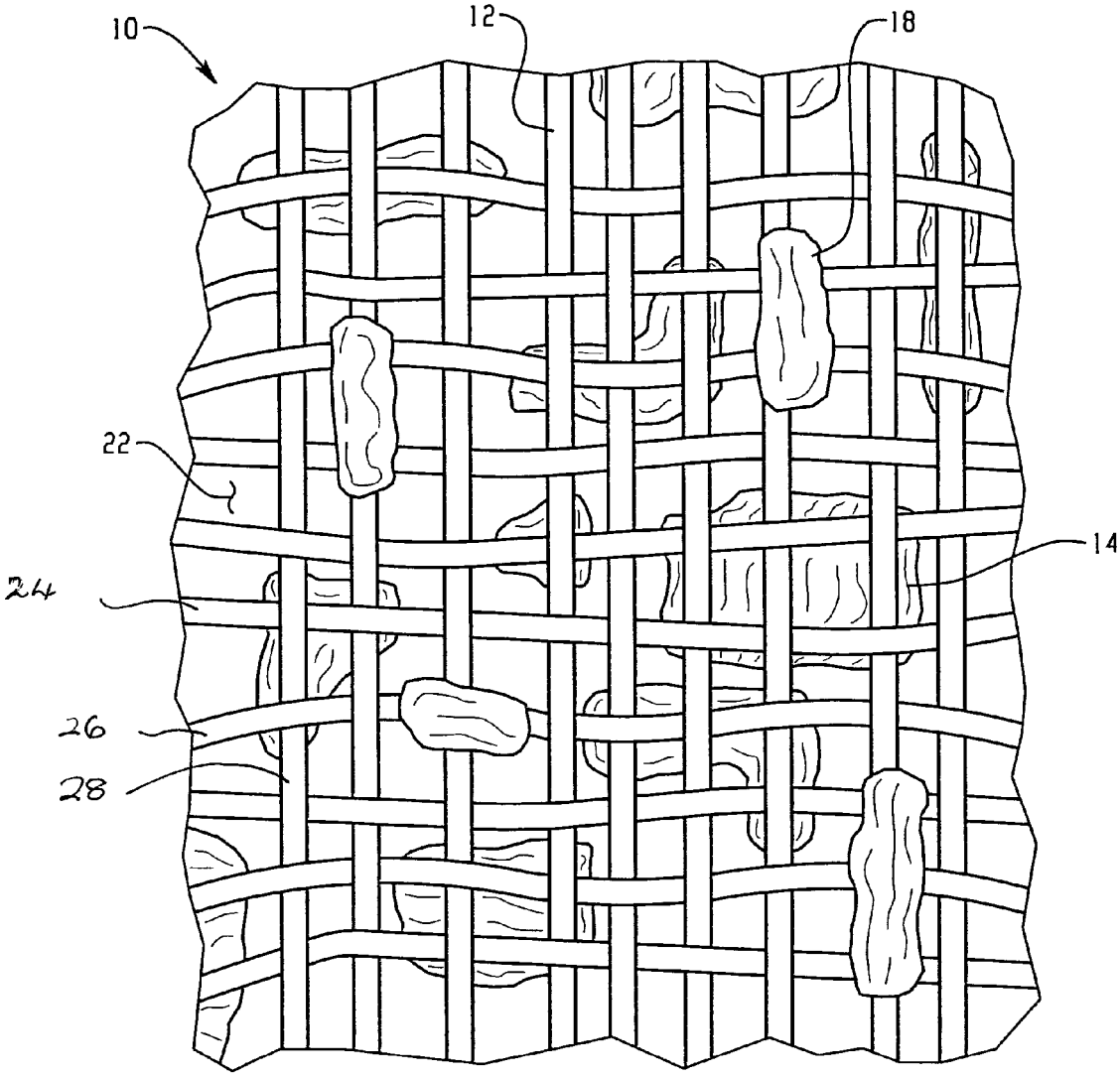
FIG. 1 is a top plan view of a composite sheet material according to the present invention.
Figure 2:
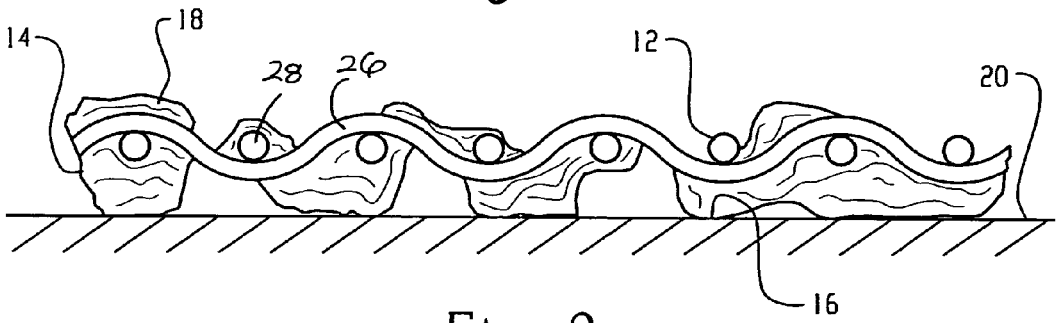
FIG. 2 is a side sectional view of the composite sheet material of FIG. 1.

With reference to FIGS. 1 and 2, a non-adhesive composite sheet material 10 useful as a drawer liner, shelf liner, or table protector is shown. The sheet material 10 comprises a layer of a scrim material 12 which is at least partially covered by a foamed resin 14. In one embodiment, the foamed resin covers or substantially covers a first major surface 16 of the layer of scrim material and partially covers a second major surface 18, leaving at least portions of the scrim material exposed or covered with a sufficiently thin layer of foam that the texture of the scrim material is clearly visible. The surface 16 is an exposed outer surface of the liner 10 and resists slipping of the liner 10 on a drawer, shelf, table, or other surface 20 which it contacts. The surface 18 is a decorative surface, which is exposed to view, when in use. The coefficient of friction between the surface 16 of the liner and a smooth surface 20, such as that of a shelf, drawer or table top, can thus be higher than the coefficient of friction between the decorative surface 18 and the surface 20 when the decorative surface is placed in contact with the same surface 20 and the same load applied.

The sheet material 10 can be in the form of a roll which is cut to the desired dimensions by a user. The roll may be about 30 cm (12") or 50 cm (20") in width and up to several meters in length. For example, a piece of the sheet material is positioned on a drawer, shelf, or other display surface 20. Items can be placed on the liner with the remaining, uncovered portion of the liner serving as a decoration for the surface.

The scrim 12 can be a natural fibrous material, such as jute, cotton, wool, flax, silk, hemp, or the like. Jute has a distinctive appearance which renders it particularly suited to providing a liner with a natural appearance. Alternatively, the scrim can be a synthetic fibrous material which has been fashioned to provide a similar texture to a natural material.

The scrim material can be woven or non-woven (e.g., entangled). Preferably, the scrim is a woven scrim having a weave, which provides a decorative effect to at least one surface 16, 18 of the composite sheet material. The weave of the scrim is preferably spaced apart so that when the scrim is impregnated with the foamable resin composition, the composition penetrates into the weave and only partially fills the spaces between the warp and the weft strands. When the impregnated composition is foamed, open pores 22 extend from one surface of the sheet material to the opposite surface. Portions 24 of the warp and weft strands 26, 28 on the decorative side 18 are free of the foam. For example, at least 10% and in one embodiment, at least 20% of the length of the warp and weft threads are exposed, at least to the naked eye.

In one embodiment, the foam is formed from a coating composition which comprises a latex, such as synthetic rubber (e.g., a styrene butadiene rubber) or natural rubber. Alternatively, other foamable material, such as polyvinyl chloride (PVC) plastisols, polyurethanes, and the like may also be utilized. The foam also includes a foaming agent and may also include plasticizers, stabilizers, antioxidants, fillers, pigments, dyes, and the like. Foamable latex compositions can be formed without the plasticizers typically used in PVC compositions and thus are particularly suited to applications where the liner is to be used on wood or lacquered surfaces. While the composite material is generally referred to herein as being formed from a jute scrim with a latex foam, it will be appreciated that other combinations of scrim and foam are also contemplated.

Where the composite sheet material is to be used as a shelf liner or the like, it will generally be advantageous to select a resin for use in impregnating the scrim which will provide a skid-resistant bottom surface on the composite sheet material. The foamed resin thus desirably has a coefficient of friction which is sufficiently high so as to prevent the composite sheet material from sliding on the horizontal surface to which it is applied.

The composite sheet material has particular utility as a covering to protect and/or improve the appearance of a horizontal surface (e.g., a shelf or drawer liner. The foamed character of the sheet material provides a cushioning effect when objects are placed on it.

Preferably, the scrim is woven in a manner which, when impregnated with the resin composition and foamed, provides a pleasant or decorative surface to the composite sheet material due to the outline of the weave which is exposed and/or shows through the surface of the foamed resin. Weaves such as plain weave, twill weave, herringbone weave, tick weave and the like are simple weaves which can be utilized to form the scrim. However, more complex weaves can be utilized to obtain different decorative effects. Many types of weaves provide scrim with a different appearance on opposite surfaces. The two different surfaces can provide different decorative surfaces to the composite sheet material.

In addition to acting as a carrier or support for the foamable resin composition during manufacture and influencing the surface appearance of the composite sheet material, the scrim also functions to increase the tensile strength and tear resistance of the sheet material.

In manufacturing the composite sheet, the scrim is impregnated or otherwise coated with a liquid foamable resin composition. The liquid foamable resin composition can be an emulsion of a foamable composition in water, a solution of the foamable composition in an organic material, or a foamable plastisol. The composition is a liquid which has a viscosity such that the scrim can be impregnated.

In one embodiment, a portion of the liquid foamable material is removed, after it is applied, from what will be the decorative surface 18, for example with a knife or other blade. In one embodiment, this step is carried out shortly after the liquid latex is applied to the jute scrim, and before any appreciable foaming occurs. The scraping leaves at least some portions of the fibers on the decorative surface 18 which, at least to the naked eye, are completely free of the foamed material. The coating on the non-slip surface 16 is thus generally thicker, on average, than on the decorative surface. This results in a larger portion of the foam being on the side of the scrim adjacent surface 16 after foaming and drying.

The foamable liquid latex composition is applied to the scrim by known means such as dipping, roller coating, spraying, knife coating and the like. The thickness of the foamable resin composition on the surface of the scrim can be controlled by means such as a knife or by passing the impregnated scrim between rollers which are preset at a distance so that excess foamable resin composition is removed. The impregnated scrim material is then passed through a heating zone if heat is required to foam the resin. If the liquid foamable resin composition is an emulsion, the water in the emulsion is first evaporated and further heating causes the resin to foam and set. If the foamable composition is a solution of the foamable resin composition in an organic solvent, the organic solvent is first removed in the heating zone and the resin foamed and set. Latent foaming agents (i.e., foaming agents which are stable at room temperature but which are activated by heating to an elevated temperature) as well as physical foaming agents (e.g., gases and volatile hydrocarbons or halocarbons) may be employed. The foamable liquid resin is impregnated into the scrim and the impregnated scrim is then heated in the heating zone to foam and gel the resin composition.

The impregnated scrim is passed through a means which ensures that the proper amount of the foamable resin composition has been applied to the scrim. Means such as knife blades, rolls and the like can be utilized to ensure that excess foamable resin composition is not adhered to the scrim.

The foaming of the resin can be constrained on the lower side 16 by pressing the impregnated scrim against a hot roll or other smooth surface. The resin foams, but contact with the surface constrains the expansion of the foam in the direction of the surface. This provides a sheet which has a decorative appearance on the decorative side 18 and a second side 16 in which the impression of the scrim showing through the foamed plastic has been substantially reduced to provide a much smoother surface. Another method of providing a smoother surface 16 is to press the surface 16 of the composite sheet against a surface, preferably a smooth surface, before the foam has set. This can be done by pressing a side of hot-foamed composite sheet against a hot or cool surface. When the resin does not require heat to foam, the surface against which the composite sheet is pressed need not be heated. Pressing after foam formation does not provide as smooth a surface as constraint during foaming. If desired, the surface against which the composite sheet is pressed can contain a pattern which becomes embossed in the surface of the composite sheet.

If the foamable resin composition is in the form of an emulsion in water, the impregnated scrim is passed through an oven to dry the resin composition and through a heating and foaming zone where the resin composition applied to the scrim is heated to a temperature to activate the foaming agent and foam and gel, cure or polymerize the resin.

The impregnated scrim can be carried through the heating zone on a frame or other means, which provides for foaming the resin composition without hindering the expansion of the foam. In an alternate embodiment, an impregnated scrim can be pressed against a smooth surface to inhibit foam expansion. The smooth surface can be heated to cause the resin composition to foam and gel or polymerize. When the impregnated scrim is pressed against a smooth surface and foamed, the surface of the scrim after foaming becomes much smoother than the surface of the scrim on which foaming was not inhibited. This method permits the formation of a composite material having a relatively smooth surface on a first side 16 and a decorative surface on the second side 18 which reflects the character of the scrim weave.

The term smooth is utilized to contrast the surface of the composite in which the foaming has been inhibited or pressed before setting with the surface in which the foaming has not been inhibited or pressed before setting. The surface 16, which has been foamed under conditions in which the foam expansion has been inhibited, can contain small irregularities due to the pressure which may be applied between the composite and the smooth surface. However, the surfaces under which the expansion of the foam has been inhibited display a lower shadowing or showing through of the outline or pattern of the scrim.

The composite sheet material can have an average thickness (excluding the openings) in the range of from about 40 mils to about 150 mils and, in one embodiment, from about 60 mils to about 90 mils. In one embodiment, 55-60% of the total volume of the latex is on the lower side 16 of the sheet material (i.e., below a plane X through the center of the scrim) and 40-45% of the latex volume is on the upper side 18 (i.e., above the plane X).

The thickness of the composite sheet material is dependent, to some degree, upon the nature of the scrim in relation to the weave and thickness, the quantity of foamable resin composition impregnated on the scrim, the type and amount of foaming agent, and to any force which has been applied to inhibit expansion of the foam. In one embodiment of the invention, the thickness of the composite sheet material and the type of scrim and foamable resin composition employed are selected such that a relatively flexible sheet is obtained which is capable of conforming closely to and gripping a horizontal surface to which the composite sheet material is applied with little or no curling. In other embodiments, however, a thicker, less flexible composite sheet material may be more desirable (e.g., where the sheet material is used as a covering for wire shelving).

Preferably, no adhesive is present on the bottom surface 16 of the composite sheet material, as this will facilitate lifting and repositioning of the composite sheet material. At the same time, however, the composite sheet material may be prevented from sliding around on the horizontal surface during normal use through the selection of a foamed resin having a relatively high coefficient of friction on the bottom surface of the composite sheet material (i.e., the surface placed in contact with a horizontal surface such as a shelf). The foamed resin may be colored using a suitable pigment or dye.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

Having thus described the preferred embodiment, the invention is now claimed to be:

1. In combination, a shelf and a shelf liner supported thereon, the shelf liner being in the form of a single layer of sheet material defining a skid-resistant first major surface contacting the shelf and a decorative second major surface, the second major surface being uppermost, the shelf liner comprising a single layer of scrim and a foamed resin in contact with the scrim which defines the first major surface, the scrim comprising fibers, the resin being discontinuous on the scrim, such that at least a portion of the scrim fibers is visible on the second major surface, open pores extending from the first major surface to the second major surface, the foamed resin being thicker, on average on a side of the scrim adjacent the second major surface, than on a side of the scrim adjacent the first major surface.

2. The combination of claim 1, wherein the foamed resin comprises a latex.

3. The combination of claim 2 wherein the latex is selected from the group consisting of synthetic rubber, natural rubber, and combinations thereof.

4. The combination of claim 1, wherein the foamed resin is free of plasticizers.

5. The combination of claim 1, wherein the scrim is woven.

6. The combination of claim 1, wherein the scrim comprises natural fibers.

7. The combination of claim 6, wherein the natural fibers are selected from the group consisting of jute, cotton, wool, flax, silk, hemp, and combinations thereof.

8. The combination of claim 6, wherein the natural fibers comprise jute.

9. The combination of claim 1, the shelf liner having a thickness from about 40 to about 150 mils.

10. The combination of claim 9, the shelf liner having a thickness of from about 60 to about 90 mils.

11. The combination of claim 1, wherein at least 55% of the foamed resin is adjacent the first major surface and less than 45% of a volume of the foamed resin is adjacent the second major surface.

12. The combination of claim 1, wherein the first major surface has a coefficient of friction which is greater than the second major surface.

13. The combination of claim 1, wherein at least 10% of a length of warp and weft threads of the scrim are visible on the second major surface.

14. A method for forming the combination of claim 1 comprising:

providing a scrim having first and second major surfaces, the scrim being formed of fibers;

impregnating the scrim with a resin composition;

scraping a portion of the resin composition away from the second major surface of the scrim, such that the fibers of the formed shelf liner are more visible on the second major surface than on the first major surface; and placing the shelf liner on a shelf.

15. In combination, a shelf and a shelf liner lining the shelf, the shelf liner being in the form of a single layer of sheet material defining a skid-resistant lower surface in contact with the shelf and a decorative uppermost surface for receiving an object thereon, a coefficient of friction between the lower surface of the shelf liner and the shelf being higher than the coefficient of friction between the decorative surface and the shelf when the decorative surface is placed in contact with the same shelf and the same load applied, the shelf liner comprising a single layer of scrim and a foamed resin in contact with the scrim which contacts the shelf, the scrim comprising fibers, the resin being discontinuous on the scrim, such that at least a portion of the scrim fibers is visible on the uppermost surface of the shelf liner, open pores extending from the uppermost surface of the shelf liner through the scrim to the lower surface of the shelf liner.

* * * * *